SR
11/19/85 XR 4,554,050

United States Patent [19]
Minford et al.

[11] Patent Number: 4,554,050
[45] Date of Patent: Nov. 19, 1985

[54] ETCHING OF TITANIUM

[75] Inventors: William J. Minford, Lehigh Township, Northampton County; Edmond J. Murphy, Bethlehem; Trudie C. Rice, North Whitehall Township, Lehigh County, all of Pa.

[73] Assignee: AT&T Bell Laboratories, Murray Hill, N.J.

[21] Appl. No.: 631,298

[22] Filed: Jul. 16, 1984

[51] Int. Cl.[4] ..... C23F 1/02; B44C 1/22; C03C 15/00; C03C 25/06

[52] U.S. Cl. ..... 156/664; 29/569 L; 156/656; 156/659.1; 350/96.12

[58] Field of Search ..... 156/656, 659.1, 664; 350/96.1, 96.12, 96.34; 29/569 L, 572; 357/17, 29-31; 148/1.5, 187, 188

[56] References Cited

U.S. PATENT DOCUMENTS 4,080,244 3/1978 Auracher et al. ..... 148/188 X

*Primary Examiner*—William A. Powell
*Attorney, Agent, or Firm*—Peter V. D. Wilde

[57] ABSTRACT

The specification describes a technique for etching titanium using EDTA compounds. It is especially useful for selective etch processes such as those used to form titanium diffused waveguides in lithium niobate crystals.

7 Claims, 2 Drawing Figures

EDTA ETCH SOLUTION

EDTA ETCH SOLUTION

ETCHING OF TITANIUM

BACKGROUND OF THE INVENTION

Recent studies on the insertion loss of $LiNbO_3$ devices have shown that optimum design will require control of the optical mode size and the degree of mode confinement in specific regions of the crystal. High mode confinement is necessary to minimize propagation and bending losses and maximize electric field overlap. A larger mode size near the edges increases the fiber to waveguide coupling efficiency at this interface. The desired degree of confinement and the mode size in the actual device region may vary with the application. Some devices require a different propagation constant (which varies with mode confinement) in each of two parallel waveguides which are separated by several microns.

The degree of mode confinement in any waveguide depends upon the physical size (cross section) of the waveguide and the magnitude of the refractive index difference between the core and the cladding. For Ti:-$LiNbO_3$ waveguides these parameters are moderately coupled due to fabrication restrictions. The geometrical dimensions can be varied by changing initial titanium strip width, diffusion temperature or diffusion time. The induced index difference can be varied by changing the diffusion parameters and by changing the initial titanium concentration. Because of the required dimensional tolerance, local control of the diffusion parameters by introducing a temperature gradient across a single crystal is difficult. Variations of the strip width and titanium concentration (or the combination of both) offer promising possibilities.

According to this invention, the amount of titanium available for diffusion is varied by removing metal in specific regions after a uniform layer has been deposited. In principle, this can be accomplished by ion milling but significant damage to the crystal results. Chemical etching using hydrofluoric acid has also been attempted but gives uncontrollable results. The thin $TiO_2$ surface layer etches very slowly but, once etched, the underlying metal dissolves nearly instantly. We have found that the EDTA etch solution gives controllable etching. We have found also that this etching solution can be used effectively with photomasking operations to yield a selective process.

DETAILED DESCRIPTION

We have demonstrated the invention using a solution of EDTA in the form of Disodium Ethylene Diamine Tetraacetic acid dihydrate and ammonium hydroxide for pH control. The etch rate on titanium at room temperature is approximately 50 Å/minute. The etch rate can be varied by changing the temperature or the composition of the solution. The etch rate can also be varied conveniently by changing the OH concentration. We have found no appreciable effect of the etchant on various typical photoresists, e.g. Shipley 1350B, 1350J or Waycoat Type 3, after immersion for thirty minutes at 25° C.

Adherence of the photoresist appears excellent for virtually any conventional process. We regard these findings as technologically significant because they allow this process to be used effectively for selective removal of metal in a wide variety of commercially important processes.

We have used this etchant to fabricate several important waveguide structures. In each case, titanium ridges of uniform height were first formed on the crystal surface by the conventional lift-off technique. Next, various regions of the crystal were masked by exposing and developing away parts of a 2μ thick layer of AZ1350J photoresist. The titanium ridges under the photoresist are, thus, protected from the etchant.

Figure 2:
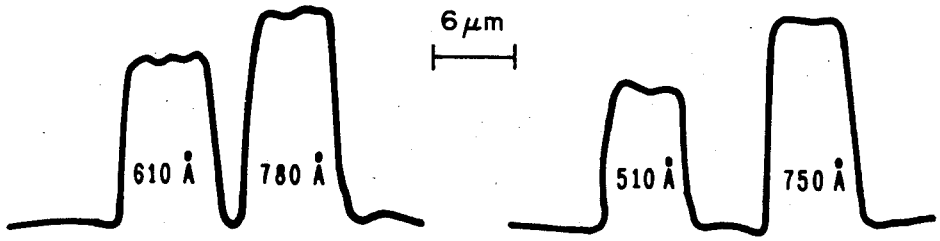
FIG. 2 is a profileometer trace showing the profiles of titanium strips exposed to the etchant.

FIG. 2 shows the result of selectively etching one of a pair of several parallel 6μ wide Ti strips. The profileometer traces clearly show the titanium thickness differential. Optical measurements on these devices after indiffusion of the titanium for six hours at 1050° C. show the expected isolation between the waveguides.

Figure 1:
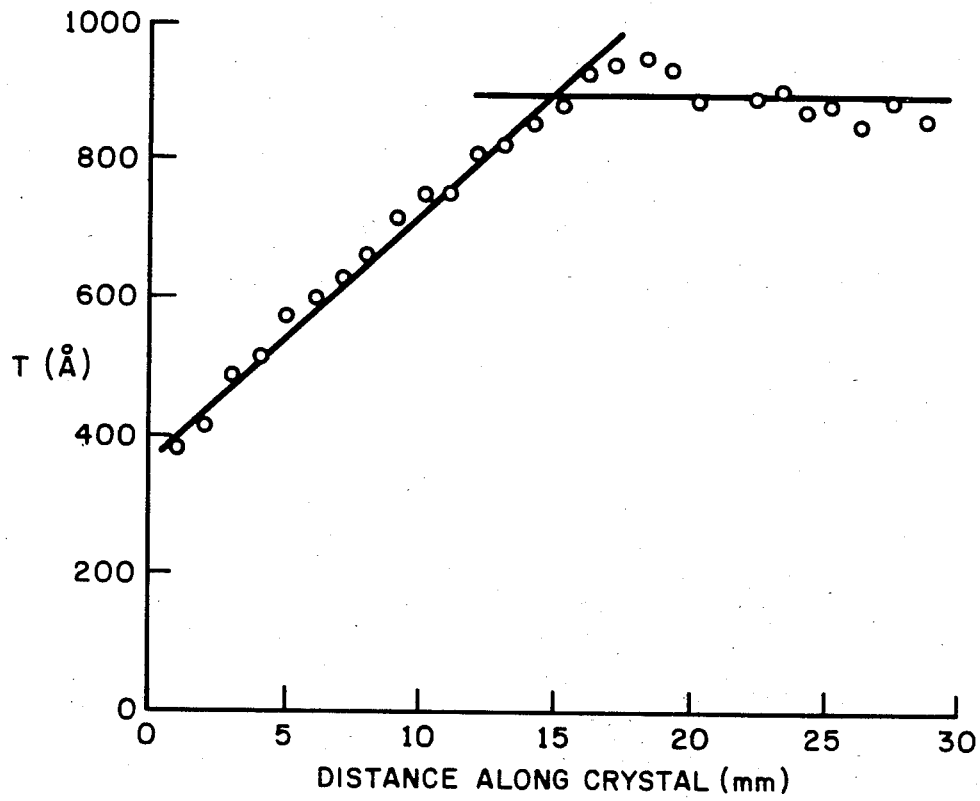
FIG. 1 is a plot showing linear thickness variation of an etched sample that was slowly withdrawn from the etch solution.

FIG. 1 shows the results of another experiment in which a crystal was slowly dipped into the etchant. The result was a slow gradation of titanium thickness as a function of length along the crystal. Optical measurements on the resulting waveguides show a significant influence on the width and depth of the optical mode.

Fabrication of electrodes which are accurately aligned to indiffused waveguides is a critical processing step. Many devices require electrodes with small gaps and intricate patterns. The conventional lift-off approach to this step is difficult. Alignment problems arises because the indiffused waveguides are difficult to focus on when viewed at high magnification through a dielectric layer, photoresist and the electrode mask.

Since the EDTA solution will also etch aluminum and other electrode materials, we can deposit a planar layer of metal directly over the dielectric film and form the electrodes by photomasking and back etching. The metal layer accentuates the waveguide due to large changes in back reflection. Thus, alignment becomes more efficient and more accurate. Mask undercutting can be a problem with any wet chemical technique. However, because of the large aspect ratio (electrode gap/electrode thickness $>30$) this effect is minimized. The etch solution used in many of the procedures just described was a 0.067M solution of Disodium Ethylene Diamine Tetraacetic acid dihydrate (2.5 grams in 100 ml deionized water) to which 10 grams of hydrogen peroxide and 4.2 grams of ammonium hydroxide were added. This solution has a pH of approximately 10. Although this solution gives desirable results it is obvious that the specific ingredients and concentration of ingredients can be varied over substantial ranges to give comparable or acceptable results. We have attempted to explore some of those variations and these will now be described.

As indicated above the temperature of the etchant affects the rate of etching as would be expected. We have used the solution at room temperature, and at 60° C. We see no reason why it would not be effective, as aqueous etching solutions usually are, in the range of 0° C. to 100° C. The EDTA compound can be chosen from a variety of acids that contain the EDTA radical, for example:

1. Ethylenediaminetetraacetic Acid
2. Disodium Ethylenediaminetetraacetic Acid
3. Trisodium Ethylenediaminetetraacetic Acid 4. Tetrasodium Ethylenediaminetetraacetate Using the compound we selected, appropriate concentrations range from ½% to 27% (the solubility limit).

We know of no critical amount of oxidation promoter needed to effect useful etching. We have used hydrogen peroxide at a concentration of 10% and we believe that concentrations can be varied from 1% to 50%. Other oxidizers most likely will give useful results, e.g. other peroxy compounds.

We chose to adjust pH using ammonium hydroxide since the alkali ions form complexes with EDTA. However, alternative sources of OH ions can undoubtedly give useful results. We have found that a pH of 9 or above is acceptable although we have not investigated thoroughly the possibilities below a pH of 9.

We have observed etch rates of from 10 to 100 Å/minute at room temperature and from 300 to 1800 Å/minute at 60° C. The etch rate depends partly on the condition of the material being etched. Oxide films over the titanium surface will impede etching. Higher etch rates than those we observed are undoubtedly possible.

Various additional modifications and deviations will occur to those skilled in the art. All such variations that rely basically on the teachings through which this invention has advanced the art are properly considered to be part of this invention.

What is claimed is:

1. Technique for etching titanium comprising the steps of:

exposing a titanium surface to a solution comprising the ethylenediaminetetraacetic acid radical for a period sufficient to etch said surface.

2. Technique for selectively etching a titanium layer comprising the steps of applying to the titanium layer a photoresist or electron beam resist layer, patterning the resist layer, and subjecting the titanium regions exposed by the resist layer to a solution comprising the ethylenediaminetetraacetic acid radical.

3. Technique of claim 1 in which the solution contains ethylenediaminetetraacetic acid in the form of disodium ethylene diamine tetraacetic acid dihydrate.

4. Technique of claim 1 in which the solution contains an oxidation promoter.

5. Technique of claim 1 in which the solution is adjusted to have a pH greater than 9.

6. Method of manufacture of an optical waveguide comprising:

forming a titanium layer on a crystal of lithium niobate, selectively masking said titanium layer, exposing the unmasked regions of the titanium layer to a solution comprising the ethylenediaminetetraacetic acid radical for a time sufficient to remove at least part of said unmasked regions, and heating the crystal to diffuse the remaining titanium into the crystal to form waveguiding regions.

7. The technique of claim 6 in which the unmasked regions of titanium are slowly withdrawn from the solution during removal so that the titanium remaining has a varying thickness.

* * * * *